US006451134B1

(12) United States Patent
Kimura et al.

(10) Patent No.: US 6,451,134 B1
(45) Date of Patent: Sep. 17, 2002

(54) 590MPA CLASS HEAVY GAUGE H-SHAPED STEEL HAVING EXCELLENT TOUGHNESS AND METHOD OF PRODUCING THE SAME

(75) Inventors: Tatsumi Kimura, Kurashiki (JP); Fumimaru Kawabata, Kurashiki (JP); Keniti Amano, Kurashiki (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/743,991

(22) PCT Filed: Jun. 24, 1999

(86) PCT No.: PCT/JP99/03378

§ 371 (c)(1),
(2), (4) Date: Jan. 18, 2001

(87) PCT Pub. No.: WO01/00894

PCT Pub. Date: Jan. 4, 2001

(51) Int. Cl.[7] ..... C21D 8/00; C21D 7/13; C22C 38/42; C22C 38/50

(52) U.S. Cl. ..... 148/330; 148/333; 148/335; 148/332; 148/654; 148/648

(58) Field of Search ..... 148/330, 322, 148/534, 654, 648, 332, 335; 420/112

(56) References Cited

U.S. PATENT DOCUMENTS 5,766,381 A 6/1998 Hayashi et al.

FOREIGN PATENT DOCUMENTS

| | | |
|---|---|---|
| JP | A 7-90473 | 4/1995 |
| JP | A 8-85846 | 4/1996 |
| JP | A 8-144019 | 6/1996 |
| JP | B2 2596836 | 1/1997 |
| JP | A 9-111397 | 4/1997 |
| JP | A 9-125140 | 5/1997 |
| JP | A 9-176730 | 7/1997 |
| JP | A 9-194985 | 7/1997 |
| JP | A 9-227985 | 9/1997 |

OTHER PUBLICATIONS

"Final Report on Bainitic Research Committee", edited by the Society of Bainite Research, The Iron and Steel Institute of Japan, Jul. 30, 1994, pp. 33–39.

*Primary Examiner*—Deborah Yee
(74) *Attorney, Agent, or Firm*—Oliff & Berridge, PLC

(57) ABSTRACT

The present invention relates to an H-shaped steel used as a building structure such as a column material or the like for highrise and super highrise building structures. In the bainite structure of extra-low-carbon steel, diffusive $\alpha_q$ is finely dispersed in $\alpha_B$ to ensure tensile strength at the 590-MPa level and significantly improve toughness in the direction of the flange thickness. Fine dispersion of $\alpha_q$ is achieved by controlling Mn and Cu in proper ranges. In other word, the present invention provides 590MPa class heavy gauge H-shaped steel with excellent as-rolled toughness in the direction of the flange thickness, containing 0.001 to 0.025 wt % of C, 0.6 wt % or less of Si, 0.4 to 1.6 wt % of Mn, 0.025 wt % or less of P, 0.010 wt % or less of S, 0.1 wt % or less of Al, 0.6 to 2.0 wt % of Cu, 0.25 to 2.0 wt % of Ni, 0.001 to 0.050 wt % of Ti, and 0.0002 to 0.0030 wt % of B, wherein Mn/Cu≦2.0 and 250≦117 Mn (wt %)+163 Cu (wt %)≦350 are satisfied.

7 Claims, 4 Drawing Sheets

590MPA CLASS HEAVY GAUGE H-SHAPED STEEL HAVING EXCELLENT TOUGHNESS AND METHOD OF PRODUCING THE SAME

TECHNICAL FIELD

The present invention relates to an H-shaped steel used as building structures. Particularly, the present invention relates to 590 MPa class heavy gauge H-shaped steel having a flange thickness of over 30 mm and a tensile strength of 590 to 740 MPa, and a method of producing the same.

BACKGROUND ART

Conventionally, box columns or welded H-shaped steel are frequently used as column materials of highrise or super highrise building structures. These box columns or welded H-shaped steel are formed by welding heavy gauge plates into box shape sections or H-shaped sections, respectively. With a column material required to have tensile strength at the level of 490 MPa or 520 MPa, an heavy gauge steel plates produced by controlled rolling and controlled cooling method, i.e., a so-called TMCP method, are welded. With a column material required to have tensile strength at the level of 590 MPa, a heavy gauge steel plates produced through two times of the quenching and tempering process are welded.

In contructing building, the reduction in construction cost and the shortening of construction time have recently strongly been required. Therefore, the use of rolled H-shaped steel as a substitute for box columns or welded H-shaped steel has been studied. In order to use rolled H-shaped steel, it is necessary to improve load carrying capacity. Specifically, it is required to use, as rolled H-shaped steel, high-strength heavy gauge H-shaped steel having a flange thickness of over 30 mm, and a quality level equivalent to or higher than thick steel plates of the box columns or welded H-shaped steel materials. There is also the tendency that from the viewpoint of earthquake proof, steel materials used for building structures including welded portions and weld heat-affected zones (referred to as "HAZ" hereinafter) are required to have high toughness. This applies to high-strength heavy gauge H-shaped steel. In other words, high toughness is required not only in the rolling direction and in the direction of the flange width but also in the direction of the flange thickness. Similarly, HAZ is also required to have high toughness equivalent to a base material and a low susceptibility to cold cracking.

For example, Japanese Unexamined Patent Publication No. Hei-9-125,140 and U.S. Pat. No. 2,596,836 disclose that strength can be improved by using TMCP heavy gauge H-shaped steel produced by a structure controlling method for making a fine ferrite structure using an inclusion. However, heavy gauge H-shaped steel having strength improved to 590 MPa has a problem in that toughness in the direction of the flange thickness is insufficient. Also this heavy gauge steel has high $P_{cm}$ which is an index for evaluating a weld cracking parameter, and thus has a problem in weldability.

On the other hand, in order to obtain 590 MPa class heavy gauge H-shaped steel, like a thick steel plate, two times of the quenching and tempering process may be applied. However, in order to form a martensite structure up to the center of the flange thickness, $P_{cm}$ is inevitably increased. In addition, the hardness of HAZ is increased to cause the problem of deteriorating toughness. Furthermore, this process causes the problem of deteriorating dimensional precision due to heat treatment strain, and the problem of increasing cost, and thus has low practicability.

In other words, for the heavy gauge H-shaped steel provided in an as-rolled state, the composition and producing method, which can solve all of the above-described problems, are not yet established at present.

Japanese Unexamined Patent Publication Nos. Hei-8-85,846 and Hei-8-144,019, and U.S. Pat. No. 5,766,381 disclose that an appropriate amount of B is added to high-Mn extra-low-carbon steel to obtain a structure mainly composed of bainite, thereby obtaining a high-strength steel material having low dependency on a cooling rate. Particularly, these publications disclose that $P_{cm}$ is significantly decreased by decreasing the carbon content to significantly improve weldability.

In accordance with recent research reports on the bainite structure and transformation behavior of low or extra low carbon steel ("Final Report of the Society of Bainite Research", edited by the Society of Bainite Research, Basic Research Group, Iron and Steel Institute of Japan), typical micro structures of extra low carbon steel are classified into five types including Polygonal ferrite (referred to as "$\alpha_P$" hereinafter), Quasi-Polygonal ferrite (referred to as "$\alpha_q$" hereinafter), Granular bainitic ferrite (referred to as "$\alpha_B$" hereinafter) bainitic ferrite (referred to as "$\alpha^o_B$" hereinafter), and Dislocated cubic martensite (referred to as "$\alpha'_m$" hereinafter). The transformation temperature lowers in this order, and transformation is changed from diffusion type transformation to shear type transformation. It can be interpreted that the effect disclosed in the above-described Japanese Unexamined Patent Publication No. Hei-8-85846, etc. results from formation of $\alpha_B$ or $\alpha^o_B$. However, $\alpha_B$ and $\alpha^o_B$ formed through the completion of bainite transformation inherit the state of $\gamma$ grains before transformation. In the hot deformation from a rectangular section to a H-shaped section, $\gamma$ grains which constitute the steel structure are crushed in the rolling direction and the width direction but less crushed in the direction of the flange thickness. Therefore, $\alpha_B$ or $\alpha^o_B$ grains in the direction of the flange thickness are coarse as compared with grains in the rolling direction and in the direction of the flange width, adversely affecting toughness in the direction of the flange thickness. From the viewpoint of the mill ability, rolled heavy gauge H-shaped steel has the rolling restriction that large reduction cannot be applied, unlike a thick plate rolling mill. Since large reduction cannot be applied, $\gamma$ grains are possibly not sufficiently refined by recrystallization. This causes difficulties in refining the structure of the heavy gauge H-shaped steel by rolling, making demand for a method for advantageously removing deterioration in toughness in the direction of the flange thickness.

An object of the present invention is to advantageously solve the problems of production cost and strength, toughness and weldability of the product, i.e., to propose heavy gauge H-shaped steel having high toughness in the direction of the flange thickness, low $P_{cm}$ and no hardening of HAZ, and a method of producing the same.

DISCLOSURE OF INVENTION

The inventors intensively studied the bainite transformation behavior of extra-low-carbon steel. As a result, it was found that in the bainite structure of extra-low carbon steel, more diffusive $\alpha_q$ grains finely dispersed in $\alpha_B$ to significantly improve toughness in the direction of the flange thickness while ensuring tensile strength at the 590 MPa level. Namely, it was found to be effective that strength is increased by decreasing the C amount against conventional common knowledge, and that Mn and Cu amounts are adjusted in appropriate ranges in order to finely disperse diffusive $\alpha_q$ grains. This resulted in the achievement of the heavy gauge H-shaped steel having excellent toughness in the direction of the flange thickness. Of course, $P_{cm}$ is low because of extra-low-carbon steel, and thus excellent weldability is exhibited. It was also found that hardening of HAZ is not observed.

Namely, the construction of the gist of the present invention is as follows:

590 MPa class heavy gauge H-shaped steel has excellent as-rolled toughness in the direction of the flange thickness, and comprises 0.001 to 0.025 wt % of C, 0.6 wt % or less of Si, 0.4 to 1.6 wt % of Mn, 0.025 wt % or less of P, 0.010 wt % or less of S, 0.1 wt % or less of Al, 0.6 to 2.0 wt % of Cu, 0.25 to 2.0 wt % of Ni, 0.001 to 0.050 wt % of Ti, and 0.002 to 0.0030 wt % of B, wherein Mn/Cu≦2.0 and 250≦117 Mn (wt %)+163 Cu (wt %)≦350 are satisfied. The 590 MPa class heavy gauge H-shaped steel further comprises one or two of 0.030 wt % or less of REM, and 0.0100 wt % or less of Ca, and/or at least one of 0.5 wt % or less of Cr, 0.5 wt % or less of Mo, 0.10 wt % or less of V, and 0.10 wt % or less of Nb.

A method of producing the 590 MPa class heavy gauge H-shaped steel having excellent toughness in the direction of the flange thickness comprises rolling steel slab having the above composition by a universal rolling mill, wherein after heating the steel slab at 1050 to 1350° C., a portion of the H-shaped steel corresponding to a flange portion is rolled by using a rough universal rolling mill in the temperature range of 750 to 1100° C. at a rolling reduction of 1 to 10% per pass, and a cumulative rolling reduction of 20% or more. The method of producing the 590 MPa class heavy gauge H-shaped steel further comprises cooling in the temperature range to 500° C. at a cooling rate of 0.05° C./s or more.

BEST MODE FOR CARRYING OUT THE INVENTION

The reason for limiting each of chemical components of the present invention will be described below.

C: 0.001 to 0.25 wt %

C is an important element for the constitution of the present invention.

Figure 1:
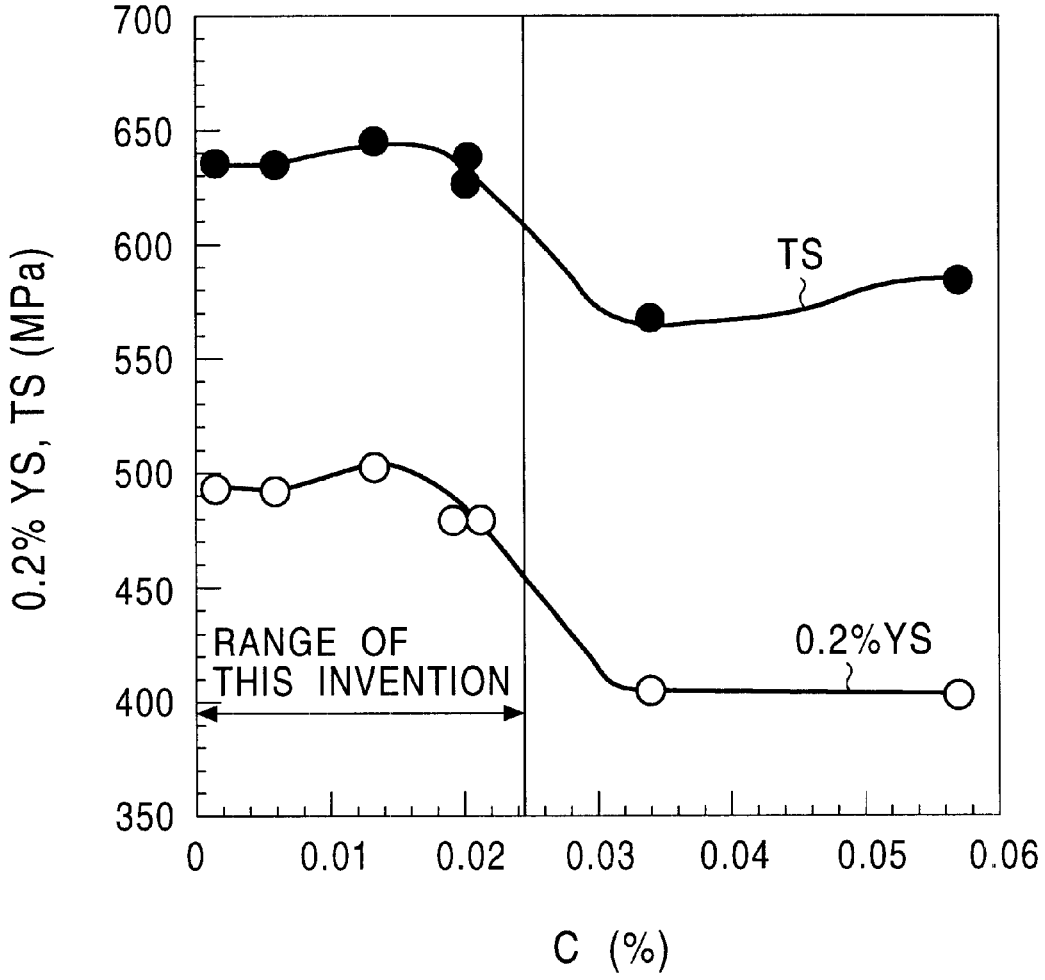
FIG. 1 is a graph showing the influence of the C content on tensile strength and yield strength.

Experiment was carried out for examining the influence of the amount of C added as follows. Vacuum melted steel containing 0.001 to 0.056% of C, 1.3 wt % of Mn, 1.0 wt % of Cu, 0.5 wt % of Ni, 0.04 wt % of Nb, and 0.0020 wt % of B was finished to a plate having a thickness of 63.5 mm by laboratory rolling, and then air-cooled, and then a tensile test specimen was cut from it. The rolling conditions included a heating temperature of 1120 to 1170° C., a cumulative rolling reduction of 53%, a rolling temperature of 1100 to 800° C., a rolling reduction of 1 to 9% per pass, and the number of passes of 17. These conditions permits the same deformation as the deformation at the ¼ flange width and the ¼ flange thickness portion in heavy gauge H-shaped steel having a flange thickness of 65 mm. The results are shown in FIG. 1 in which tensile strength is marked with ●, and yield strength is marked with ○. In FIG. 1, addition of over 0.025 wt % C deteriorate tensile strength (TS) and yield strength (YS) with 0.2% yield strength against conventional common knowledge, and tensile strength (TS) does not reach 590 MPa. This is due to the production of $\alpha_p$ in the cooling step after rolling. Conversely, in the C content region of 0.025 wt % or less, recovered $\alpha_p$ is not formed, but $\alpha_B+\alpha_q$ is formed, thereby maintaining high tensile strength. Therefore, the upper limit of C is 0.025 wt %. In order that the C content is less than 0.001%, it is necessary to increase the degassing time and select raw materials to be used, causing difficulties in stable production. Therefore, the proper C range is 0.001 to 0.025 wt %.

Si: 0.6 wt % or less

Si is useful as a solid-solution strengthening element. However, the addition of over 0.6 wt % of Si accelerates embrittlement of HAZ. Therefore the upper limit of Si is 0.6 wt %. Although the lower limit is not specified, the Si content is preferably 0.05 wt % or more for deoxidization and ensuring strength Mn: 0.4 to 1.6 wt %

Mn is an important element for stably obtaining $\alpha_B$. However, with a Mn content of over 1.6 wt %, an $\alpha_q$ transformation nose is excessively shifted to the long-time side, causing difficulties in fine dispersion of $\alpha_q$. In order to improve toughness in the direction of the flange thickness, it is important to finely disperse $\alpha_q$ grains, which is a characteristic of the present invention. Therefore, the addition of over 1.6 wt % of Mn inhibits toughness in the direction of the flange thickness due to the absence of $\alpha_q$. On the other hand, with a Mn content of less than 0.4 wt %, the $\alpha_B$ structure is not obtained, and desired strength cannot be obtained. Therefore, the lower limit is 0.4 wt %.

The amount of Mn added must be controlled with respect to the relation between Mn and Cu. This will be described later.

P: 0.025 wt % or less

P segregates in the γ grain boundaries to decrease grain boundary strength. Therefore, the P content is as low as possible. Particularly, in order to decrease toughness of HAZ, the upper limit is 0.025 wt %.

S: 0.010 wt % or less

S combines with Mn to form an inclusion MnS. In drawing by rolling, particularly, toughness in the direction of the flange thickness is deteriorated by MnS. Therefore, the S content must be as low as possible, and the upper limit of S is 0.010 wt %.

Al: 0.1 wt % or less

Al is used as a deoxidizer. However, with an Al content of over 0.1 wt %, the amount of alumina clusters is increased to deteriorate toughness, and thus the upper limit is 0.1 wt %. In the use of Ti as a deoxidizer, Al addition is not necessary.

Cu: 0.6 to 2.0 wt %

Cu is an important element used as a substitute for Mn in the present invention. On the other hand, fine $\alpha_q$ dispersion causes deterioration in yield strength. In order to compensate for deterioration in yield strength, 0.6 wt % or more of Cu is required. Namely, the $\alpha_B$ transformation temperature is decreased by increasing the Cu amount to precipitate Cu in $\alpha_q$ and $\alpha_B$ during the cooling step after rolling, thereby increasing tensile strength and refining $\alpha_q$ and $\alpha_B$. However, the addition of less than 0.6 wt % has a small effect, while the addition of over 2.0 wt % of Cu deteriorates HAZ toughness. Therefore, Cu addition is in the range of 0.6 to 2.0 wt %, preferably 0.7 to 1.5 wt %. Furthermore, the adding amount must be controlled with respect to the relation between Cu and Mn. This will be described later.

Ni: 0.25 to 2.0 wt %

0.25 wt % or more of Ni is required for preventing high-temperature cracking by Cu in continuous casting and rolling. With an adding amount of over 2.0 wt %, the effect is saturated, and thus the upper limit is 2.0 wt %.

Ti: 0.001 to 0.050 wt %

Ti has the effect of suppressing coarsening of HAZ crystal grains to improve HAZ toughness. At the same time, Ti fixes N in steel to form TiN, and leaves B as a solid solution B, thereby suppressing the $\alpha_P$ formation due to the transformation on the grain boundaries. In some cases, Ti is used as a deoxidizer in place of Al. However, with less than 0.001 wt % of Ti, these effects are not observed, while the addition of over 0.050 wt % of Ti deteriorates toughness of a parent material. Therefore, the amount of Ti added is in the range of 0.001 to 0.050 wt %. In order to exhibit the sufficient effect, the Ti amount is preferably in the range of 0.005 to 0.025 wt %.

B: 0.0002 to 0.0030 wt %

B is an important element which segregates on the γ grain boundaries to suppress $\alpha_P$ transformation on the grain boundaries. The effect of the addition of less than 0.0005 wt % of B is small, while the effect of the addition of over 0.0030 wt % of B saturates. Therefore, the amount of B added is in the range of 0.0005 to 0.0030 wt %.

$Mn/Cu \leqq 2.0$ and $250 \leqq 117Mn\ (wt\ \%) + 163Cu\ (wt\ \%) \leqq 350$

In the present invention, the amounts of Mn and Cu must be controlled according to the above equations. The reason for this will be described below.

Figure 2:
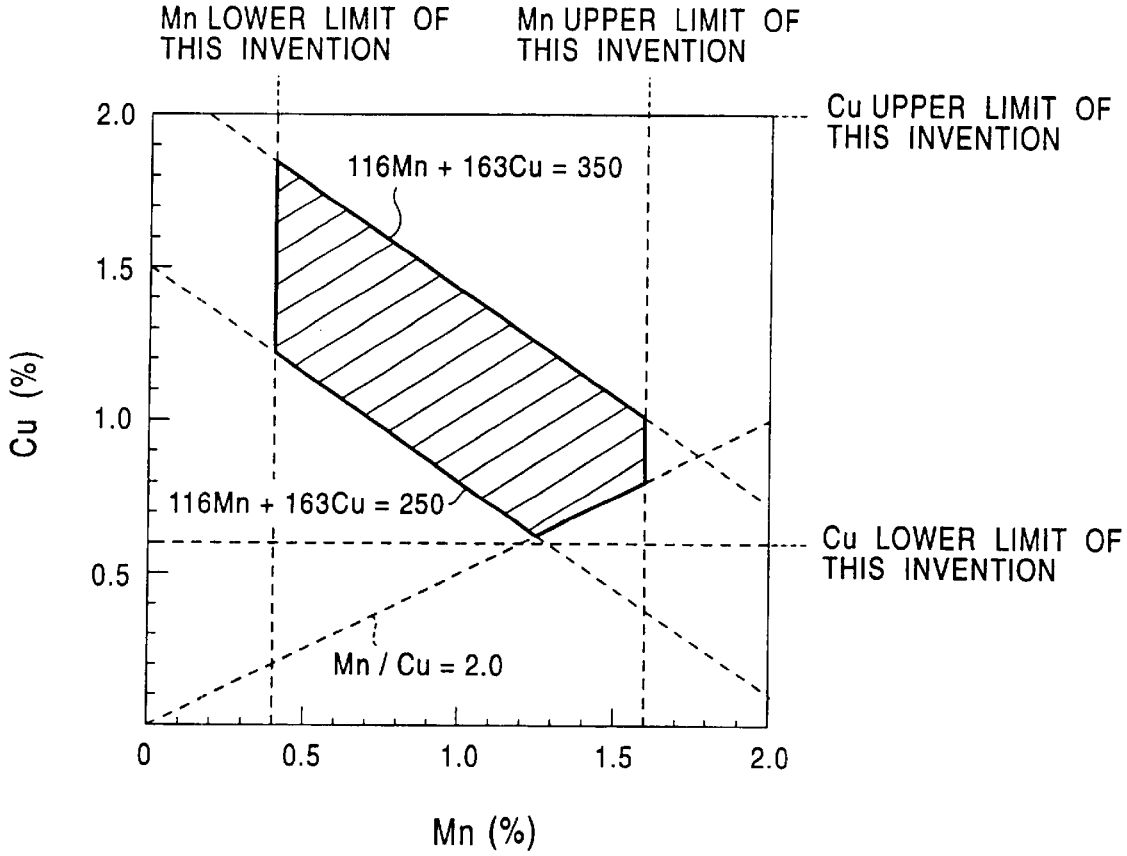
FIG. 2 is a graph showing Mn and Cu content regions for simultaneously achieving high strength (tensile strength of 590 to 740 MPa), and high toughness (Charpy absorbed energy of 47 J or more) in the thickness direction.

Experiment was carried out for examining the influences of the amounts of Mn and Cu addition as follows. Vacuum melted steel containing 0.018 wt % of C, 0.3 wt % of Si and 0.0020 wt % of B, and Mn and Cu in changing amounts was subjected to laboratory rolling, and then tensile test specimens and Charpy impact test specimens were cut out. The lengthwise direction of a tensile test specimen coincides with the rolling direction. A specimen for Charpy impact test was obtained from a rolled material in the thickness direction thereof, and a notch was formed at the ½ thickness portion of the rolled material. Rolling conditions were set to give the same deformation as the deformation of the ¼ flange width and the ¼ flange thickness portion of heavy gauge H-shaped steel having a flange thickness of 65 mm. FIG. 2 shows a region of Mn and Cu contents by hatching, which simultaneously satisfy high strength (tensile strength of 590 (Mpa) to 740 (MPa)) and high toughness (Charpy absorbed energy of 47 J or more). In a Mn/Cu region of over 2.0 (the lower right portion below a line of Mn/Cu=2.0), $\alpha_q$ is not found, and thus toughness in the thickness direction deteriorates. While even in the Mn/Cu region of 2.0 or more (the upper left portion above the line of Mn/Cu=2.0), in the region of 117Mn+163Cu of over 350 (the upper right portion above a line of 117Mn+163Cu=350), tensile strength is excessively increased to relatively deteriorate toughness. In the region of 117Mn+163Cu of less than 250 (the lower left portion below the line of 117Mn+163Cu=250), tensile strength is lower than the 590 MPa level. In consideration of the upper and lower limits of Mn and Cu, the hatching region shown in FIG. 2 is a region in which strength and toughness in the thickness direction are most balanced.

Figure 3:
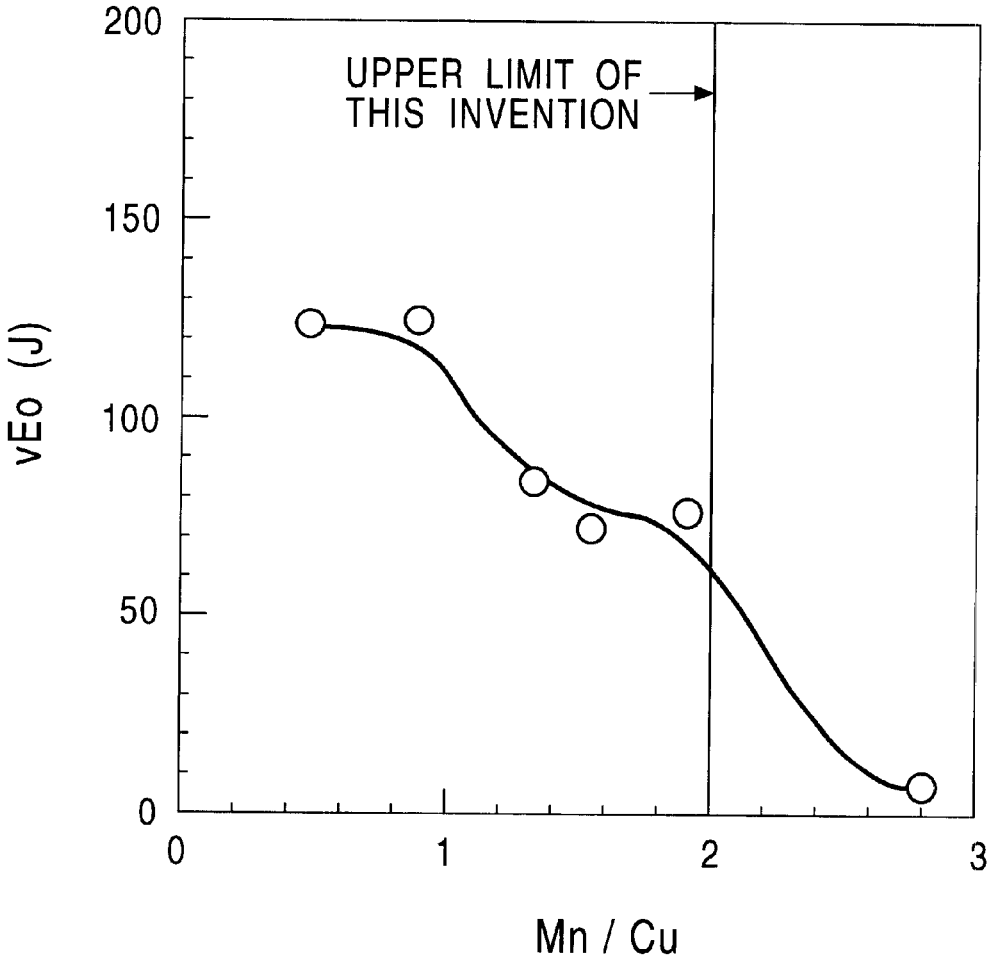
FIG. 3 is a graph showing the influence of Mn/Cu on Charpy absorbed energy in the thickness direction.

Vacuum melted steel containing 0.018 wt % of C, 0.3 wt % of Si and 0.0020 wt % of B, and Mn and Cu in changing amounts was rolled-at a heating temperature of 1170° C. with a cumulative rolling reduction of 40%, and then Charpy impact test specimens were cut out so that the lengthwise direction of a specimen coincided with the thickness direction of a plate. A notch was formed in the Charpy specimen at the ½ thickness portion of the rolled material. FIG. 3 shows the relation between the Charpy absorbed energy in the thickness direction and Mn/Cu. FIG. 3 indicates that with a Mn/Cu ratio of 2.0 or less, the Charpy absorbed energy in the thickness direction is significantly increased. This is due to the dispersion of $\alpha_q$ in $\alpha_B$. In other words, in steel having the composition in the above-described range, $\alpha_q$ for improving toughness in the thickness direction is dispersed in the steel structure mainly compose of $\alpha_B$. As a result, 590 MPa class heavy gauge H-shaped steel for building structures, which has excellent as-rolled toughness in the direction of the flange thickness and no hardening of HAZ is obtained. Although the $\alpha_q$ structure ratio is not specified, an $\alpha_q$ volume fraction of less than 10% deteriorates toughness in the direction of the flange thickness, and the presence of over 50% causes a decrease in strength and an increase in yield ratio. Therefore, the volume fraction of $\alpha_q$ is preferably in the range of 10 to 50%.

In the present invention, the predetermined chemical components below can also be added to the above fundamental components.

One or two of 0.030 wt % or less of REM and 0.0100 wt % or less of Ca

REM forms REM(O, S), and Ca forms CaS to change MnS extensible in the rolling direction into fine grain inclusions. As a result, toughness in the direction of the flange thickness can further be improved. However, the addition of large amounts significantly decreases purity of steel, and thus REM is in the range of 0.030 wt % or less, and Ca is in the range of 0.0100 wt % or less. In order to obtain the sufficient effect of improving toughness in the direction of the flange thickness, 0.002 wt % or more of REM, and 0.0005 wt % or more of Ca are preferably added.

At least one element selected from the group consisting of 0.5 wt % or less of Cr, 0.5 wt % or less of Mo, 0.10 wt % or less of V, and 0.005 to 0.10 wt % of Nb These elements are added for controlling the transformation point, and mainly added for controlling strength according to changes in rolling and cooling conditions due to changes in size of heavy gauge H-shaped steel.

Cr is effective for increasing the strength of a parent material and a welded portion. However, the addition of over 0.5 wt % of Cr deteriorates weldability and toughness of HAZ. Therefore, Cr can be added in the range of 0.5 wt % or less. In order to obtain the sufficient effect of improving strength, 0.05 wt % or more of Cr is preferably added.

Mo effectively contributes to improvement in strength at room temperature and higher temperatures. However, the addition of over 0.5 wt % of Mo deteriorates weldability and toughness of HAZ. Therefore, Mo can be added in the range of 0.5 wt % or less. In order to sufficiently increase strength, 0.05 wt % or more of Mo is preferably added.

V has the effect of increasing strength by precipitation strengthening. However, the addition of over 0.10 wt % of V deteriorates weldability. Therefore, V can be added in the range of 0.10 wt % or less. In order to obtain the sufficient effect of increasing strength, 0.02 wt % or more of V is preferably added.

Nb is advantageous as an element for precipitation strengthening and transformation strengthening, and advantageous as an element for enlarging the austenite unrecrystallized region, and refining the structure. However, the addition of a large amount of Nb deteriorates toughness of a parent material and HAZ. Therefore, Nb can be added in the range of 0.1 wt % or less. In order to exhibit the sufficient effect, 0.005 wt % or more of Nb is preferably added.

Although the composition is controlled as described above to obtain 590 MPa class of tensile strength heavy gauge H-shaped steel having excellent toughness in the direction of the flange thickness, and no hardening of HAZ, the production method described below can advantageously achieve these characteristics.

Namely, steel slab (including cast slab) having the composition controlled to the above-described fundamental composition is heated to 1050 to 1350° C., and then rolled in the temperature range of 750 to 1100° C. so that in a flange portion of H-shaped steel, the rolling reduction is 1 to 10% per pass, and the cumulative rolling reduction is 20% or more, followed by cooling. Alternatively, after rolling, accelerated cooling is performed in the temperature range to 500° C. at a cooling rate of 0.05° C./s or more to disperse $\alpha_q$ in $\alpha_B$, thereby obtaining 590 MPa level tensile strength heavy gauge H-shaped steel for building structures, which has excellent as-rolled toughness in the direction of the flange thickness and no hardening of HAZ.

The reason for setting the heating temperature to 1050° C. or more is that the structure is made uniform austenite, and the load of rolling by a breakdown mill is decreased. On the other hand, heating at a temperature above 1350° C. causes significant grain growth of austenite in extra-low-carbon steel. In small load rolling heavy gauge H-shaped steel, as described below, it is impossible to sufficiently refine such coarse grains by recrystallization, and thus toughness deteriorates. Therefore, the heating temperature is 1050 to 1350° C.

In hot rolling after forming by the breakdown rolling mill, a flange portion of H-shaped steel is rolled by a plurality of passes using a rough universal rolling mill in the temperature range of 750 to 1100° C. with a rolling reduction of 2 to 10% per pass, and a cumulative rolling reduction of 20% or more, to make a fine structure. In this case, the cumulative rolling reduction of the flange portion by the rough universal rolling mill is calculated from a variation in thickness of the ¼ flange width portion. Namely, if the thickness before rough rolling is A, and the thickness after rough rolling is B, the cumulative rolling reduction is (A−B)/A×100 (%).

In the rolling temperature range of 1100° C. or more, it is difficult to make a fine structure, causing deterioration in toughness. Therefore, the upper limit of the rolling temperature is preferably 1100° C.

The temperature region of 950 to 1100° C. is the recrystallized region of γ grains, while the region of 950° C. or less is the unrecrystallized region of γ grains. Therefore, in the temperature region of 950° C. or less, rolling is performed in as a low temperature region as possible. This is because a deformed zone is introduced to ensure $\alpha_q$ precipitation cites. However, with a rolling reduction of less than 1% per pass, the effect is not observed. Therefore, it is necessary to ensure a rolling reduction of 1% or more per pass.

A rolling temperature of less than 750° C. causes the problem of surface quality, such as the occurrence of surface cracks. Therefore, the lower limit of the rolling temperature is preferably 750° C.

In order to examine the influence of the cumulative rolling reduction, the following experiment was carried out.

Figure 4:
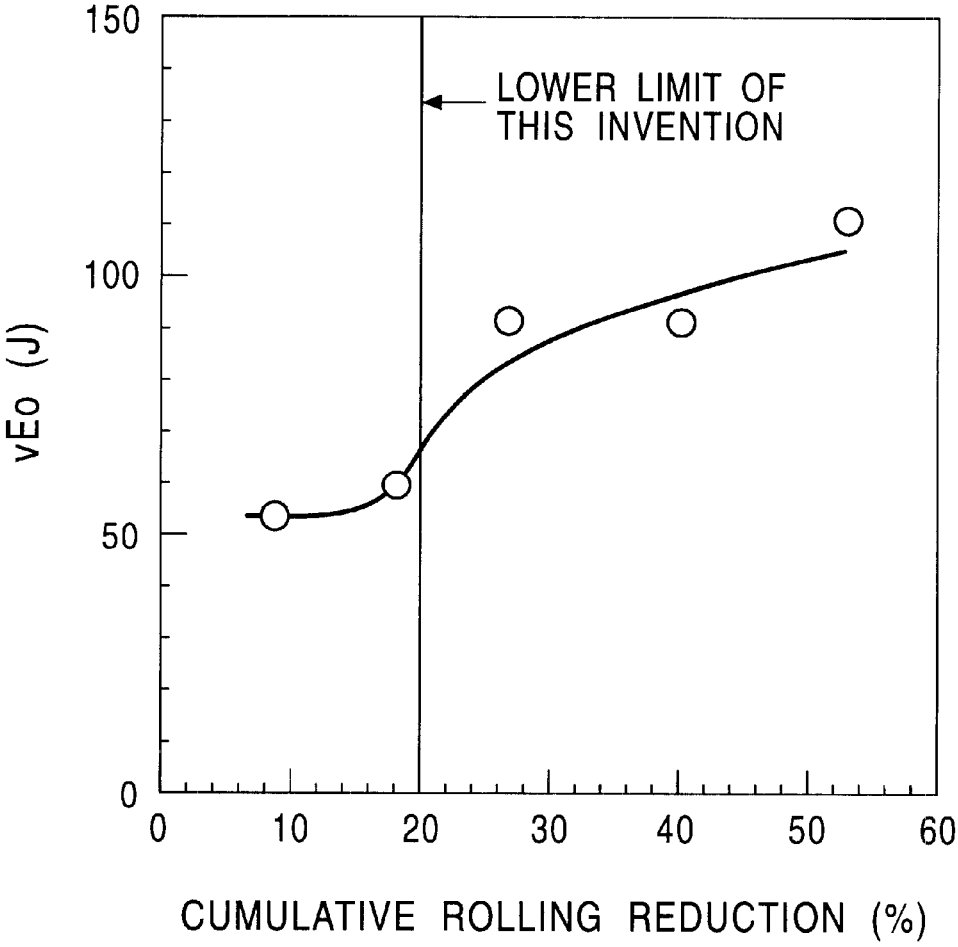
FIG. 4 is a graph showing the influence of a cumulative rolling reduction on Charpy absorbed energy in the thickness direction.

Vacuum melted steel containing 0.018 wt % of C, 0.3 wt % of Si, 1.3 wt % of Mn, 1.0 wt % of Cu, and 0.0020 wt % of B was rolled at a heating temperature of 1170° C. with changing cumulative rolling reductions, and then Charpy impact test specimens were obtained in the thickness direction of the rolled materials. A notch was formed in a Charpy impact test specimen at the ½ thickness portion of the rolled material. FIG. 4 shows the results of a Charpy impact test. In the region of cumulative rolling reductions of 20% or more, Charpy!absorbed energy in the thickness direction significantly increases. Therefore, the lower limit of the cumulative rolling reduction is preferably 20%.

Cooling after hot rolling may be either air cooling or accelerated cooling. Particularly, in order to refining and further strengthening the structure, accelerated cooling is preferably performed in the temperature range up to 500° C. at a cooling rate of 0.05° C./s or more after rolling. The upper limit of the cooling rate is not limited. However, in consideration of deformation due to thermal stress, etc., the cooling rate is preferably 20° C./s or less. Cooling after rolling means cooling after finish rolling, but accelerated cooling may be carried out in a finish rolling system after the completion of rough rolling.

EXAMPLES

Heavy gauge H-shaped steel having a flange thickness of 40 to 100 mm was produced by using steel slab controlled to each of the compositions shown in Table 1 according to the conditions shown in Table 2.

JIS No. 4 tensile test piece and JIS No. 4 impact test piece were obtained from the ¼ flange width and the ¼ flange thickness portion of each of the thus-obtained H-shapes steel products in the rolling direction. Also, JIS No. 4 impact test piece was obtained from the ¼ flange width and the ½ thickness portion. The mechanical properties of these test pieces were examined. In order to examine maximum HAZ hardness, hardness was measured after welding at room temperature according to the test method for HAZ highest hardness defined in JIS Z3101. In order to evaluate HAZ toughness, a small sample was cut from the ¼ flange length portion from the end of the flange, and then subjected to a heat cycle corresponding to a heat input of 20 kJ/cm and comprising heating to 1400° C. and then cooling in the range of 800 to 500° C. for 12 seconds. Then, a Charpy impact test piece was obtained, and absorbed energy at 0° C. was measured. The volume fractions of the $\alpha_q$ and $\alpha_B$ structures were measured by observing a micro structure (nital corrosion) of the ½ depth portion using an optical microscope or scanning electron microscope, and calculating by point counting method.

The results of measurement are shown in Table 2. The heavy gauge H-shaped steel obtained according to the present invention exhibited a high: tensile strength of 596 to 678 MPa, and excellent toughness of 53 J at 0° C. in the direction of the flange thickness. The steel of the present invention exhibited a high volume fraction of $\alpha_B$ structure, and a high volume ratio of $\alpha_B$ to $\alpha_q$. In microscopic observation, $\alpha_q$ dispersed in the structure mainly composed of $\alpha_B$ was observed in the steel of the present invention. In addition, hardening of HAZ was low, and HAZ toughness was excellent.

Furthermore, in order to evaluate the weld cracking parameter, an oblique Y-groove weld cracking test defined in JIS Z3158 was carried out. Namely, a specimen of 40 mm thick×150 mm width×200 mm length was obtained from a flange of H-shaped steel, and then welded by using a coated electrode for high-tensile-strength steel at a weld pre-heating temperature of room temperature under conditions including 170 A, 24 V and 150 mm/min. As a result, no crack was observed in the welded portions and HAZ of the steel of the present invention.

Steel K of a comparative example had a high Mn/Cu ratio, and a small fraction of $\alpha_q$, and thus exhibited low toughness in the direction of the flange thickness. Steel L had a C content of as high as 0.035 wt %, and thus exhibited deterioration in strength due to acceleration of $\alpha_p$ transformation. Steel M had a C content of as low as 0.005 wt %, but exhibited an increase in amount of $\alpha_q$ and deterioration in tensile strength because 117Mn+167Cu was as low as 245. Conversely, steel N exhibited a decrease in the transformation temperature of $\alpha_B$, excessive increase in strength, and deterioration in toughness because 117Mn+167Cu was as high as 405. Steel O subjected to two times of quenching and tempering, which were conventionally carried out, exhibited excellent strength and toughness including toughness in the direction of the flange thickness, but the amount of HAZ hardening was as high as 142 because of the high C content. Furthermore, as a result of Y-slit weld cracking test, many weld cracks were observed in comparative steel at room temperature, and sufficient performance cannot be exhibited.

As described above, it was confirmed that the steel of the present invention has excellent as-rolled strength, toughness and weldability.

Industrial Applicability

The present invention can provide a heavy gauge H-shaped steel which can easily be produced in an industrial scale, and which has high tensile strength of the 590 MPa class and excellent toughness including toughness in the direction of the flange thickness, high weldability, and excellent HAZ toughness without hardening of HAZ. Therefore, in the recent tendency to demand high toughness of building structures from the viewpoint of earthquake proof, the present invention can industrially stably provide a heavy gauge H-shaped steel having high strength, high toughness and high performance, and is thus very advantageous.

TABLE 1

| Steel | C | Si | Mn | P | S | Al | Cu | Ni | Ti | B | Cr | Mo | V | Nb | REM | Ca | Mn/Cu | 117Mn+163Cu | Remarks |
|---|---|---|---|---|---|---|---|---|---|---|---|---|---|---|---|---|---|---|---|
| A | 0.010 | 0.46 | 0.73 | 0.011 | 0.001 | 0.019 | 1.03 | 0.50 | 0.017 | 0.0025 | — | — | — | — | — | — | 0.71 | 253 | Example of this invention |
| B | 0.017 | 0.28 | 1.32 | 0.010 | 0.004 | 0.024 | 1.02 | 0.48 | 0.015 | 0.0021 | — | — | — | — | 0.008 | — | 1.29 | 321 | |
| C | 0.018 | 0.31 | 1.28 | 0.008 | 0.002 | 0.028 | 1.05 | 0.51 | 0.016 | 0.0022 | — | — | — | 0.047 | — | — | 1.22 | 321 | |
| D | 0.024 | 0.33 | 1.24 | 0.008 | 0.003 | 0.038 | 0.85 | 0.46 | 0.012 | 0.0020 | 0.24 | — | — | 0.040 | — | — | 1.46 | 284 | |
| E | 0.007 | 0.40 | 1.06 | 0.013 | 0.002 | 0.005 | 0.98 | 0.93 | 0.012 | 0.0020 | — | 0.21 | 0.042 | 0.072 | — | — | 1.08 | 284 | |
| F | 0.015 | 0.21 | 1.08 | 0.014 | 0.003 | — | 1.22 | 0.63 | 0.013 | 0.0021 | — | — | — | 0.032 | — | 0.0043 | 0.89 | 325 | |
| G | 0.016 | 0.28 | 1.18 | 0.010 | 0.002 | 0.028 | 1.00 | 0.48 | 0.015 | 0.0026 | — | 0.14 | — | 0.008 | — | 0.0039 | 1.18 | 301 | |
| H | 0.018 | 0.30 | 1.29 | 0.007 | 0.001 | 0.028 | 1.13 | 0.55 | 0.012 | 0.0020 | 0.13 | — | — | 0.042 | 0.007 | — | 1.14 | 335 | |
| I | 0.024 | 0.28 | 1.31 | 0.009 | 0.003 | 0.027 | 1.15 | 0.48 | 0.013 | 0.0018 | 0.10 | — | — | 0.045 | 0.005 | — | 1.14 | 341 | |
| J | 0.010 | 0.30 | 1.30 | 0.009 | 0.002 | 0.03 | 1.15 | 0.50 | 0.012 | 0.0021 | 0.11 | — | — | 0.041 | 0.005 | — | 1.13 | 340 | |
| P | 0.001 | 0.53 | 1.23 | 0.010 | 0.002 | 0.032 | 0.92 | 0.55 | 0.014 | 0.0015 | — | — | — | 0.045 | — | — | 1.34 | 294 | |
| Q | 0.003 | 0.46 | 1.46 | 0.011 | 0.002 | 0.028 | 0.85 | 0.52 | 0.012 | 0.0018 | — | 0.43 | — | — | — | — | 1.72 | 309 | |
| K | 0.018 | 0.30 | 1.58 | 0.010 | 0.003 | 0.027 | 0.53 | 0.26 | 0.012 | 0.0018 | — | — | — | 0.045 | 0.007 | — | 2.98 | 271 | Comparative example |
| L | 0.035 | 0.18 | 1.26 | 0.008 | 0.003 | 0.021 | 0.99 | 0.51 | 0.016 | 0.0011 | — | 0.28 | — | 0.023 | — | — | 1.27 | 309 | |
| M | 0.005 | 0.24 | 0.53 | 0.013 | 0.002 | 0.015 | 1.12 | 0.43 | 0.011 | 0.0020 | — | — | — | 0.031 | — | — | 0.47 | 245 | |
| N | 0.023 | 0.33 | 1.33 | 0.014 | 0.003 | 0.034 | 1.53 | 0.82 | 0.014 | 0.0018 | — | — | — | 0.038 | — | — | 0.87 | 405 | |
| O | 0.12 | 0.25 | 1.35 | 0.008 | 0.002 | 0.03 | 0.20 | 0.15 | 0.01 | — | — | 0.25 | 0.043 | — | 0.006 | — | 6.75 | 191 | |

TABLE 2

| Steel | Flange thickness (mm) | Heating temperature (° C.) | Rolling reduction [/pass] (%) | Number of passes | Cumulative rolling reduction (%) | Rolling temperature range (° C.) | Cooling method | Cooling rate (° C./s) | YS (MPa) | TS (MPa) | YR (%) | EL (%) | vEo*1 (J) | vEo*2 (J) | HAZ*4 amount of hardening ΔHV | vEo [HAZ] (J) | $\alpha_a$ (%) | $\alpha_B$ (%) | Remarks |
|---|---|---|---|---|---|---|---|---|---|---|---|---|---|---|---|---|---|---|---|
| A | 80 | 1170 | 1-8 | 17 | 46 | 1100–890 | Water cooling | 0.25 | 482 | 610 | 79 | 30 | 304 | 155 | 67 | 171 | 37 | 63 | Example |
| B | 60 | 1150 | 1-10 | 21 | 56 | 1020–830 | Air cooling | — | 501 | 647 | 77 | 31 | 300 | 136 | 46 | 181 | 21 | 79 | of this |
| C | 65 | 1190 | 1-8 | 19 | 54 | 1090–900 | Air cooling | — | 493 | 658 | 75 | 27 | 296 | 118 | 46 | 153 | 18 | 82 | invention |
| C | 40 | 1230 | 2-10 | 23 | 62 | 1090–830 | Air cooling | — | 528 | 667 | 79 | 30 | 354 | 148*3 | 46 | 153 | 16 | 84 | |
| D | 65 | 1170 | 1-10 | 19 | 56 | 1080–850 | Air cooling | — | 490 | 625 | 78 | 29 | 325 | 140 | 67 | 164 | 29 | 71 | |
| E | 100 | 1220 | 1-8 | 15 | 37 | 1100–940 | Water cooling | 0.13 | 475 | 596 | 80 | 25 | 233 | 103 | 35 | 138 | 42 | 58 | |
| F | 80 | 113O | 1-8 | 17 | 46 | 1050–890 | Air cooling | — | 496 | 638 | 78 | 26 | 271 | 135 | 50 | 206 | 25 | 75 | |
| G | 80 | 1150 | 1-9 | 17 | 46 | 1080–860 | Air cooling | — | 489 | 628 | 78 | 27 | 287 | 103 | 43 | 175 | 30 | 70 | |
| H | 60 | 1120 | 1-10 | 21 | 56 | 990–820 | Air cooling | — | 526 | 678 | 78 | 30 | 327 | 120 | 55 | 197 | 10 | 90 | |
| I | 60 | 1120 | 1-10 | 21 | 56 | 990–820 | Air cooling | — | 507 | 653 | 78 | 30 | 336 | 115 | 72 | 152 | 13 | 87 | |
| J | 60 | 1120 | 1-10 | 21 | 56 | 990–820 | Air cooling | — | 521 | 666 | 78 | 31 | 347 | 135 | 44 | 173 | 10 | 90 | |
| C | 65 | 1270 | 1-9 | 19 | 54 | 1080–900 | Air cooling | — | 493 | 662 | 74 | 25 | 181 | 73 | 46 | 153 | 16 | 84 | |
| C | 80 | 1180 | 1-5 | 9 | 18 | 1070–980 | Air cooling | — | 487 | 649 | 75 | 26 | 158 | 53 | 46 | 153 | 18 | 82 | |
| P | 105 | 1120 | 1-8 | 15 | 35 | 1050–830 | Air cooling | — | 463 | 601 | 77 | 29 | 222 | 123 | 22 | 220 | 21 | 79 | |
| P | 65 | 1320 | 1-8 | 19 | 54 | 1150–900 | Air cooling | — | 487 | 644 | 76 | 27 | 253 | 100 | 22 | 220 | 17 | 83 | |
| Q | 125 | 1130 | 1-8 | 17 | 27 | 1030–820 | Air cooling | — | 495 | 625 | 79 | 26 | 207 | 86 | 25 | 231 | 12 | 88 | |
| C | 125 | 1120 | 1-8 | 17 | 27 | 1030–870 | Air cooling | — | 463 | 601 | 77 | 28 | 152 | 60 | 46 | 153 | 27 | 73 | |
| C | 65 | 1330 | 1-8 | 19 | 54 | 1050–900 | Air cooling | — | 482 | 637 | 76 | 28 | 201 | 67 | 46 | 153 | 21 | 79 | |
| K | 65 | 1170 | 1-8 | 19 | 54 | 1080–880 | Air cooling | — | 475 | 600 | 79 | 28 | 236 | 10 | 48 | 172 | 5 | 95 | Compara- |
| L | 65 | 1130 | 1-9 | 19 | 54 | 1030–820 | Water cooling | 0.19 | 412 | 563 | 73 | 35 | 325 | 98 | 80 | 18 | *5 | | tive |
| M | 80 | 1190 | 1-8 | 17 | 46 | 1100–900 | Air cooling | — | 483 | 566 | 85 | 33 | 279 | 120 | 40 | 132 | 63 | 37 | example |
| N | 65 | 1150 | 1-8 | 19 | 46 | 1080–870 | Air cooling | — | 594 | 758 | 78 | 20 | 130 | 7 | 45 | 43 | 0 | 100 | |
| O | 60 | 1150 | 1-8 | 19 | 46 | 1080–870 | Air cooling | — | 469 | 627 | 75 | 30 | 334 | 127 | 142 | 36 | *6 | | |

*1The rolling direction,
*2The direction of the flange thickness,
*3Charpy specimens were collected in the thickness direction after the flange thickness was increased to 60 mm by pressure welding,
*4Amount of HAZ hardening = maximum hardness of heat-affected zone − hardness of parent material,
*5Comparative Example L comprising low-carbon ferrite + bainite structure ($\alpha_p$: 73%),
*6Comparative Example O subjected to two times of quenching and tempering

What is claimed is:

1. A 590 MPa class heavy gauge H-shaped steel with excellent as-rolled toughness in the direction of the flange thickness, comprising 0.001 to 0.025 wt % of C, 0.6 wt % or less of Si, 0.4 to 1.6 wt % of Mn, 0.025 wt % or less of P, 0.010 wt % or less of S, 0.1 wt % or less of Al, 0.6 to 2.0 wt % of Cu, 0.25 to 2.0 wt % of Ni, 0.001 to 0.050 wt % of Ti, 0.0002 to 0.0030 wt % of B, 0.05 to 0.5 wt % of Cr, one or two of 0.030 wt % or less of REM and 0.0100 wt % or less of Ca, and at least one of 0.5 wt % or less of Mo, 0.10 wt % or less of V, and 0.10 wt % or less of Nb, wherein Mn/Cu≦2.0 and≦250≦117 Mn (wt %)+163 Cu (wt %)≦350 are satisfied.

2. The 590 MPa class heavy gauge H-shaped steel according to claim 1, further comprising one or two of 0.030 wt % or less of REM and 0.0100 wt % or less of Ca.

3. The 590 MPa class heavy gauge H-shaped steel according to claim 1, further comprising at least one of 0.5 wt % or less of Mo, 0.10 wt % or less of V, and 0.10 wt % or less of Nb.

4. A method of producing a 590 MPa class heavy gauge H-shaped steel with excellent as-rolled toughness in the direction of the flange thickness, comprising heating a steel stab having the composition according to claim 1 to 1050 to 1300° C., rolling said steel stab using a universal rough rolling mill to produce H-shaped steel, and rolling a portion of the H-shaped steel corresponding to a flange portion in a temperature range of 750–1100° C. with a rolling reduction of 1–10% per pars, with a cumulative rolling reduction of 20% or more.

5. The method of producing a 590 MPa class heavy gauge H-shaped steel with excellent as-rolled toughness in the direction of the flange thickness according to Claim 4, further comprising cooling in a temperature range up to 500° C. at a cooling rate of 0.05° C./s or more after rolling said flange portion of the H-shaped steel.

6. A method of producing a 590 MPa class heavy gauge H-shaped steel with excellent as-rolled toughness in the direction of the flange thickness, comprising heating a steel stab having the composition according to claim 2 to 1050 to 1300° C., rolling said steel stab using a universal rough rolling mill to produce H-shaped steel, and rolling a portion of the H-shaped steel corresponding to a flange portion in a temperature range of 750–1100° C. with a rolling reduction of 1–10% per pars, with a cumulative rolling reduction of 20% or more.

7. A method of producing a 590 MPa class heavy gauge H-shaped steel with excellent as-rolled toughness in the direction of the flange thickness, comprising heating a steel stab having the composition according to claim 3 to 1050 to 1300° C., rolling said steel stab using a universal rough rolling mill to produce H-shaped steel, and rolling a portion of the H-shaped steel corresponding to a flange portion in a temperature range of 750–1100° C. with a rolling reduction of 1–10% per pars, with a cumulative rolling reduction of 20% or more.

* * * * *

UNITED STATES PATENT AND TRADEMARK OFFICE

CERTIFICATE OF CORRECTION

PATENT NO. : 6,451,134 B1
DATED : September 17, 2002
INVENTOR(S) : Tatsumi Kimura et al.

It is certified that error appears in the above-identified patent and that said Letters Patent is hereby corrected as shown below:

Column 13,
Line 30, change “pars” to -- pass --.

Column 14,
Line 17, change “pars” to -- pass --.

Column 15,
Line 28, change “pars” to -- pass --.

Signed and Sealed this

Eighteenth Day of February, 2003

JAMES E. ROGAN
*Director of the United States Patent and Trademark Office*